United States Patent [19]

Liu

[11] Patent Number: 4,922,394

[45] Date of Patent: May 1, 1990

[54] GLASS DESK LAMP

[76] Inventor: C. H. Liu, No. 8, Lane 244, Swc. 5, Yen-Ping N. Rd., Taipei, Taiwan

[21] Appl. No.: 261,023

[22] Filed: Oct. 20, 1988

[51] Int. Cl.[5] ..... F21V 21/26

[52] U.S. Cl. ..... 362/269; 362/360; 362/368; 362/332; 362/396

[58] Field of Search ..... 362/351, 332, 360, 361, 362/410, 413, 269, 355, 356, 396, 455, 457, 806, 368, 370, 372, 335, 430

[56] References Cited

U.S. PATENT DOCUMENTS

| | | | |
|---|---|---|---|
| 616,400 | 12/1898 | Burger | 362/332 |
| 1,978,251 | 10/1934 | Doane | 362/431 |
| 2,343,173 | 2/1944 | Dupler | 362/361 |
| 3,356,841 | 12/1967 | Horan | 362/413 |
| 3,593,014 | 7/1971 | Vesely | 362/360 |
| 3,872,297 | 3/1975 | Rohlof | 362/360 |
| 4,669,034 | 5/1987 | Bansbach | 362/339 |

*Primary Examiner*—Ira S. Lazarus

*Assistant Examiner*—D. M. Cox

*Attorney, Agent, or Firm*—Lowe, Price, LeBlanc, Becker & Shur

[57] ABSTRACT

This invention relates to a glass desk lamp having a lamp, a support and a base, the lamp including a plurality of rings and glass discs joined together by screws so as to form a transparent hood, two caps disposed on two ends of the transparent hood for receiving a bulb and a fixing stand. The support is a C-shaped member having an L-shaped connector at both of its ends for fixing the bulb, the base plates and glass discs and three connecting rods. The base plate has three notches formed for the passage of therethrogh of the connecting rods which are separated by with a distance therebetween, both ends of the connecting rods being provided with threads for engaging with bolts or nuts. The support extends between the upper connecting rods and the lower connecting rod and is disposed between the base plates to engage with nuts, thereby forcing the base plates to clamp the support tightly.

5 Claims, 2 Drawing Sheets

GLASS DESK LAMP

FIELD OF THE INVENTION

This invention relates to a glass desk lamp and in particular to one consisting of a transparent hood and a base made of thick glass plates.

SUMMARY OF THE INVENTION

This invention relates to a glass desk lamp comprising a lamp, a support and a base comprising a plurality of cooperating base plates. The lamp comprises a plurality of rings and glass discs joined together by screws so as to form a transparent hood, two caps disposed on the two ends of the transparent hood for receiving a bulb and a fixing stand; said support comprising a C-shaped member having an L-shaped connector at each end thereof for fixing the blub, said base plates and glass discs and three connecting rods, said base plates each having three notches for the passage of the connecting rods which are separated by a sleeve between adjacent base plates so as to keep a selected distance therebetween, both ends of each connecting rod being provided with threads for engaging with bolts or nuts, said support extending between an uppermost connecting rod and the lower connecting rod and disposed between the base plates, the connecting was being disposed to engage with nuts thereby forcing said base plates closer to clamp the support tightly.

BRIEF DESCRIPTION OF THE DRAWING

The present invention will now be described in conjunction with the accompanying drawings.

DESCRIPTION OF THE PREFERRED EMBODIMENTS

Figure 1:
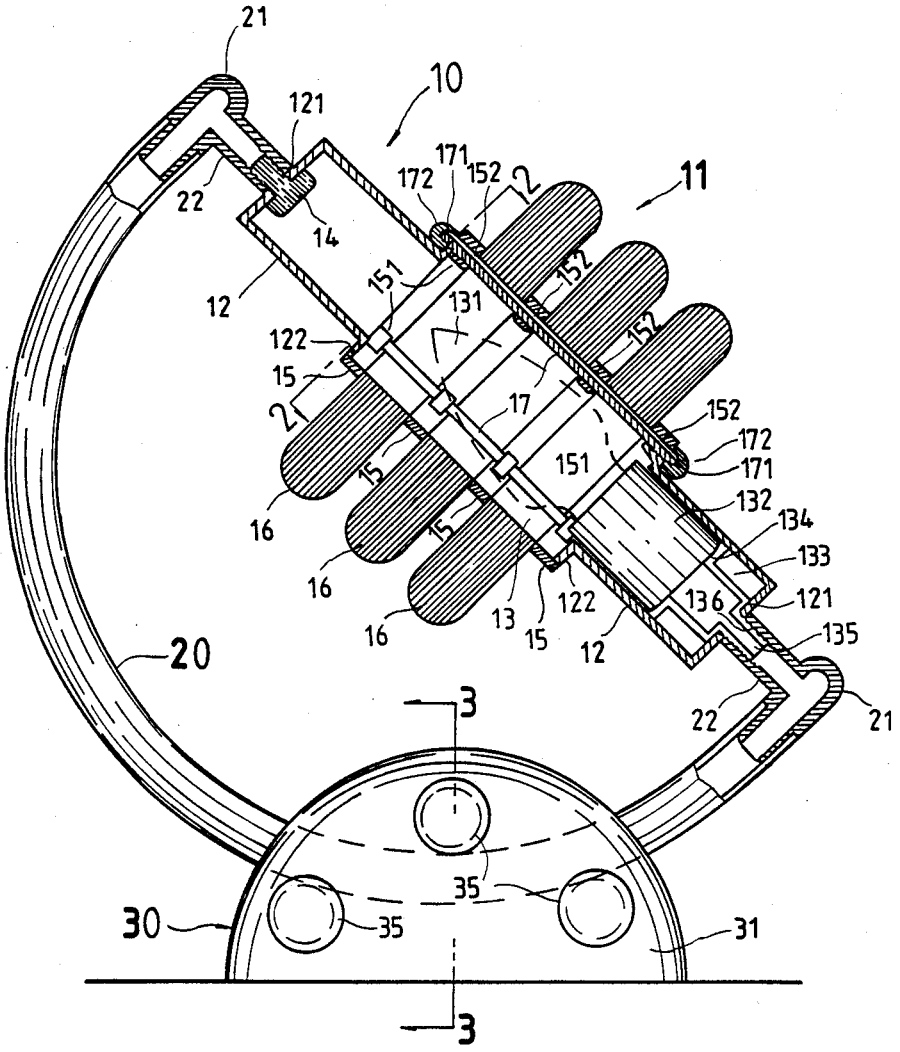
FIG. 1 is a partially sectioned front view of a glass desk lamp according to the present invention.
Figure 2:
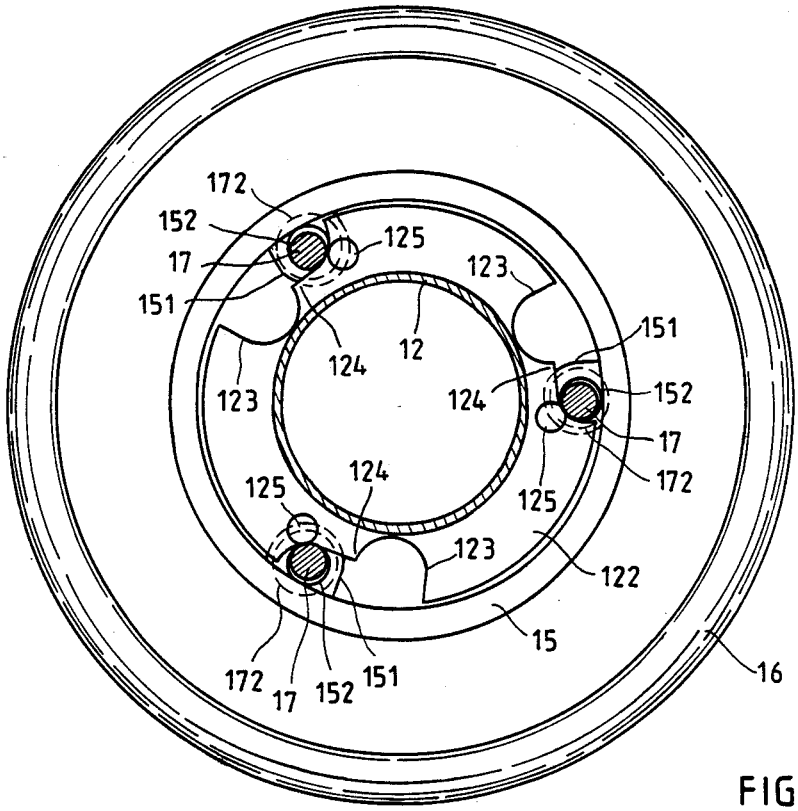
FIG. 2 is a sectional view taken along line 2—2 of FIG. 1.
Figure 3:
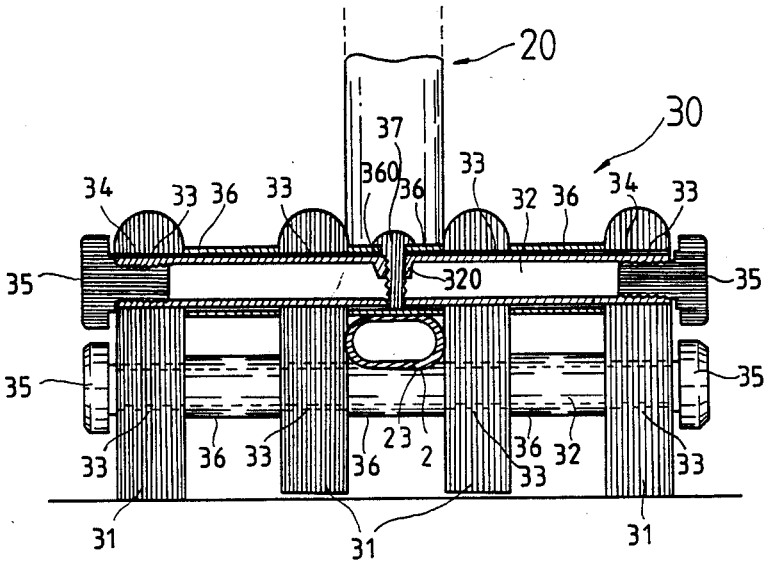
FIG. 3 is a sectional view taken along line 3—3 of FIG. 1.

With reference to the drawings and in particular to FIG. 1 thereof, the glass desk lamp according to the present invention mainly comprises a lamp 1, a support 2 and a base 3.

The lamp 1 is composed of a transparent hood 11, two caps 12, a bulb 13 disposed within the transparent hood 11 and the cap 12, and two fixing stands 133. The transparent hood 11 has a plurality of rings 15, a plurality of glass discs 16 and at least two screws 17 connected together. The preferred embodiment has four rings 5, three glass discs 16, and three screws 17. The ring 15 is circular in shape and has three inner projections 151 on the center of which there is a hole 152 just adjacent to the inner surface of the ring 15. The glass disc 16 is at least 10 mm in thickness, with a center equal to or larger than the inner diameter of the ring 15 but smaller than the outer diameter of the ring 15.

The screw 17 can just go through the hole 152 of the projection 151 of the ring 15. Both ends of the screw 17 are provided with threads 171 engaged with a nut 172 so as to fix the glass discs 16 along the same axis and between the rings 15. The screw 17 is first inserted through the hole 152 of the projection 151 of the ring 15 and then engaged with the nut 172, thereby fixing the glass discs 16 into a whole body with an inner chamber.

The cap 12 has a cylindrical member with an open end. The closed end of the cap 12 is formed with a fixing hole 121 around which are a plurality of small holes 180 for heat dissipation. The open end of the cap 12 has a flange 122 formed with three notches 123 which extend outwards to form a guiding recess 124. At the end of the guiding recess 124 there is a protuberance 125. The cap 12 is fixed at the end of the ring 15 by turning the cap 12 so that the guiding recess 124 slides through the screw 17 to engage with the nut 172.

The lamp 13 includes a bulb 131, a lamp holder 132 and a fixing strand 133. The fixing stand 133 is also cylindrical in shape and is formed at the open end with an annular flange 134 which is joined to the end of the lamp holder 132 by screws. On the closed end of the fixing stand 133 there is a tubular portion 135 with external threads 136. The lamp holder 132 is used to receive the bulb 131 and is accomodated into the cap 12 with the fixing stand 131. Hence, the bulb 131 may emit light through the glass discs 16.

The support 2 is a C-shaped member with two L-shaped connectors 21 which have a tubular member 22 and internal threads on the inner surface thereof. The cap 12 is threadedly connected to the L-shaped connector 21. It should be noted that the number of rings 15 and glass discs 16 can be increased as desired. Further, the support 2 has a hole 23 for the passage of a wire.

The base 3 consists of four plates 31 and three connecting rods 32. The plate 31 is semi-circular in shape and made of thick glass plates in which there are three holes 33.

Each connecting rod 32 is formed from a tubular metal member just passing through the holes 33 of the base plate 31. Both ends of the connecting rod 32 are preferably provided with internal threads 34 and engaged with a bolt 35. The outside surface of the connecting rod 32 is enclosed by a sleeve 36 with a larger diameter than the circular hole 33 of the base plate 31. The sleeves 36 are clamped between adjacent pairs of the base plates 31. The center of the connecting rod 32 has an axial hole 320 extending through its wall. Each sleeve 36 is also formed with a hole 360 engaged with the bolt 37. The end of the bolt 37 is designed to press the sleeve 36. The three connecting rods 32 extend to the corresponding holes 33 of the base plate 31.

The lamp 2 extends through the space between the lower end of the upper connecting rod and the uppermost ends of the two connecting rods. The bolt 37 are designed to fix the base plate 31 the inner ones of which will clamp two sides of the lamp 2. When the bolt 37 on the center of the upper connecting rod 32 is turned tightly, the outer surface of the sleeve 36 will press on the support 2, thereby enabling the lamp 1 to be located at a selected fixed angular position.

Although a preferred embodiment of this invention has been described with a certain degree of particularity, it is understood that the present disclosure is made by way of example only and that numerous changes in the construction and the combination and arrangement of parts may be resorted to without departing from the spirit and scope of the invention as hereinafter claimed.

I claim:

1. A glass desk lamp, comprising:

a lamp;

a support and:

a base, comprising a plurality of cooperating base plates;

wherein said lamp comprises a plurality of rings and a plurality of glass discs joined together by screws so as to form a transparent hood, two caps disposed on the two ends of the transparent hood for receiving a bulb and a fixing stand, said support comprising a C-shaped member having an L-shaped connector at each end thereof for fixing the bulb therebetween, said base plates each having three holes for the passage of connecting rods therethrough, each of said connecting rods passing through a sleeve disposed between adjacent base plates to keep a selected distance therebetween, both ends of each connecting rod being provided with threads for engaging with bolts or nuts, said support extending between an uppermost connecting rod and the other, lower, connecting rods and being disposed between two of the base plates, the bolts or nuts being applied to the connecting rods to force said base plates closer to clamp the support tightly.

2. The glass disk lamp as claimed in claim 1, wherein: each of said rings is provided on an inner surface with at least two protuberances through which extend the same number of screws protruding therefrom to engage nuts, thereby connecting the rings and the glass discs together.

3. The glass desk lamp as claimed in claim 1, wherein: said lamp includes a bulb, a bulb holder, and a fixing stand having a tubular portion connected with said support.

4. The glass desk lamp as claimed in claim 1, wherein: said C-shaped support has an L-shaped connector at each of its two ends and an internal threaded cylindrical body on the opposite side thereof.

5. The glass desk lamp as claimed in claim 1, wherein: the uppermost of said connecting rods is formed with a hole axially extending therethrough, and the sleeve also has a through hole and is engaged with a bolt to thereby clamp the support tightly.

* * * * *